United States Patent [19]

Holman et al.

[11] Patent Number: 4,541,684

[45] Date of Patent: Sep. 17, 1985

[54] AIRCRAFT GROUNDING RECEPTACLE

[75] Inventors: Howard E. Holman; Roy D. Turner, both of Fort Worth, Tex.

[73] Assignee: T. J. Electronics, Inc., Arlington, Tex.

[21] Appl. No.: 466,915

[22] Filed: Feb. 16, 1983

[51] Int. Cl.[4] ..... H01R 4/66

[52] U.S. Cl. ..... 339/14 L; 361/215

[58] Field of Search ..... 361/215, 217; 339/182, 339/183, 258 R, 258 P, 14 R, 14 L, 14 P, 120 R, 120 J

[56] References Cited

U.S. PATENT DOCUMENTS

| | | | |
|---|---|---|---|
| 1,564,855 | 12/1925 | Jurs | 361/215 |
| 1,564,925 | 12/1925 | Anthony | 361/215 |
| 1,749,179 | 3/1930 | Davis, Jr. | 361/215 |
| 1,785,729 | 12/1930 | Davis, Jr. | 361/215 |
| 2,434,534 | 1/1948 | Alford | 339/113 B |
| 2,958,843 | 11/1960 | Long | 339/14 L X |
| 3,038,972 | 6/1962 | Lagier | 339/14 L X |
| 3,145,329 | 8/1964 | Deakin et al. | 357/74 |
| 3,258,734 | 6/1966 | Greasley | 339/176 R |

*Primary Examiner*—Eugene F. Desmond

*Attorney, Agent, or Firm*—Michael A. O'Neil

[57] ABSTRACT

An aircraft grounding receptacle comprising a connector portion and a tubular portion. The connector portion includes an external thread and a hexagonal portion. The tubular portion includes a reduced diameter portion and a hexagonal flange. Four slots separate the tubular portion into four segments and intersect the flange at locations spaced apart from four of the six points comprising the hexagonal shape of the flange. A bore extends through the body for receiving an aircraft grounding plug and includes reduced diameter portions for mating engagement with the terminal groove of the plug.

6 Claims, 4 Drawing Figures

AIRCRAFT GROUNDING RECEPTACLE

TECHNICAL FIELD

This invention pertains to an aircraft grounding receptacle for mounting on an aircraft and for receiving an aircraft grounding plug to effect a grounding connection during fueling operations.

BACKGROUND AND SUMMARY OF THE INVENTION

In the fueling of aircraft it is necessary to form a grounding connection between the aircraft and the fueling apparatus. Otherwise, a charge of static electricity can build up, leading to an electrical arc or spark discharge. This can cause ignition of the fuel, resulting in damage to the equipment and injury or death of personnel.

At the present time, the grounding of an aircraft during fueling is accomplished using a plug comprising an elongate cylinder formed from a conductive metal and having a groove surrounding its distal end. The plug is received in a receptacle mounted on the aircraft which comprises a brass fitting having a beryllium copper spring staked or riveted thereto. The spring is in the form of a hook and includes a rounded tip adapted for engagement with the groove of the plug to form an electrical and mechanical connection between the plug and the receptacle.

It has been found that the present receptacle design incorporates a number of highly disadvantageous characteristics. First, the beryllium copper spring forms an electrical connection with the plug by means of a single point contact. If disengagement between the spring and the plug should occur for any reason, for example, due to vibration or otherwise, an electrical arc can form resulting in ignition of the fuel.

Other disadvantages result from the use of dissimilar metals to form the component parts of the receptacle. Such dissimilar metal construction can lead to increased electrical resistance. Also, because of its two-piece construction, the receptacle is subject to damage if excessive torque is used during installation. Still another disadvantage inherent in the present design involves the fact that only a limited amount of mechanical force can be applied through the beryllium copper spring against the plug which can lead to increased electrical resistance at the point of contact between the spring and the plug.

The present invention comprises an aircraft grounding receptacle which eliminates the foregoing and other problems long since associated with the prior art. In accordance with the broader aspects of the invention, an aircraft grounding receptacle is machined from a unitary length of bar stock comprising an electrically conductive material. The receptacle includes a connecting portion and a tubular portion extending from the connecting portion to a flange situated at the opposite end of the receptacle. A passageway extends through the receptacle to reduced diameter portions situated adjacent to flange and adapted to matingly receive the groove of an aircraft grounding plug. Four slots extend into the tubular portion from the flange to permit the segments of the tubular portion to flex outwardly to receive and grip the grounding plug.

The use of the present invention results in numerous advantages over the prior art. First, when an aircraft grounding plug is received in a receptacle incorporating the present invention, a total of eight contact points are established between the receptacle and the plug. This eliminates the possibility that a single point contact will somehow become disengaged, leading to a spark discharge. Second, the grounding plug is gripped by four contact tines arranged in two opposed groups, thereby substantially eliminating the possibility of disengagement between the plug and the receptacle. Third, substantially greater mechanical contact pressure between the plug and the receptacle is achieved by means of the invention, which in turn reduces the electrical resistance between the plug and the receptacle. Finally, the present invention comprises a one-piece construction. This provides a receptacle which is capable of withstanding up to twenty times as much mechanical torque as is the case with prior designs, while simultaneously eliminating the problem of increased electrical resistance which can result when dissimilar metals are used in fabricating a grounding receptacle.

BRIEF DESCRIPTION OF THE DRAWINGS

A more complete understanding of the invention may be had by reference to the following Detailed Description when taken in conjunction with the accompanying drawings, wherein.

DETAILED DESCRIPTION

Figure 4:
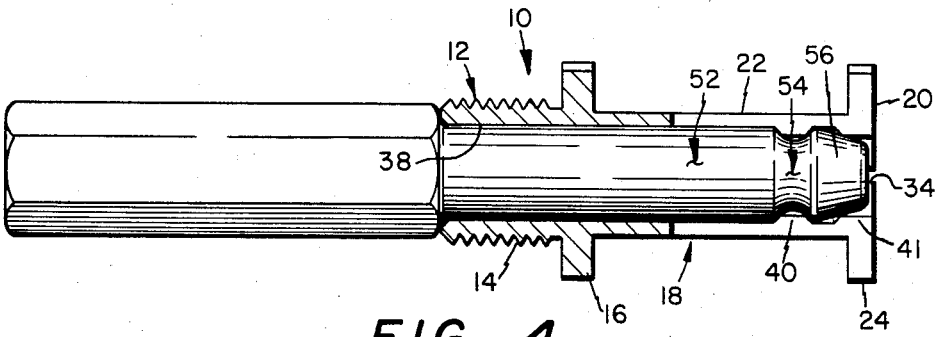
FIG. 4 is a longitudinal sectional view showing a grounding plug installed in the receptacle.

Referring now to the drawings, and particularly to FIG. 4 thereof, there is shown an aircraft grounding receptacle 10 incorporating the present invention. The receptacle 10 comprises a unitary length of electrically conductive metal. In accordance with the preferred embodiment, the receptacle 10 is formed from beryllium copper alloy.

The receptacle 10 includes a connector portion 12. In the preferred embodiment of the invention, the connector portion 12 comprises an external thread 14. However, other conventional types of connectors may be utilized in the practice of the invention, if desired. The connector portion 12 further includes a hexagonal portion 16. The hexagonal portion 16 is adapted for mating engagement with a suitable wrench or other tool to facilitate installation or removal of the receptacle 10.

A tubular portion 18 extends from the connector portion 12 to the distal end 20 of the receptacle 10. The tubular portion 18 includes a section 22 which is circular in cross-section. The tubular portion 18 further includes a hexagonal flange 24 situated at the end 20 of the receptacle 10. The tubular portion 18 is separated into four segments, 26, 28, 30 and 32, by four slots 34.

Figure 3:
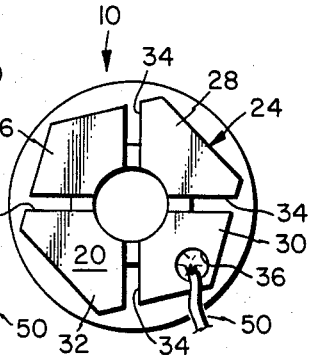
FIG. 3 is an end view thereof.

As is best shown in FIG. 3, the four slots 34 are situated at 90° intervals around the periphery of the receptacle 10. In actual practice, opposed slots 34 may be formed simultaneously. The slots 34 intersect the hexagonal flange 24 at points adjacent to but not coincident with four of the six points defining the hexagonal shape of the flange. The portion of the flange 24 comprising the segment 30 of the tubular portion 18 of receptacle 10 is provided with a hole 36 which may be used to receive a grounding wire or lead. A similar grounding wire hole may be formed in the portion of the flange 24 comprising the segment 26, if desired.

Referring again to FIG. 4, a circular bore 38 is formed through the receptacle 10. The bore 38 is of uniform diameter through the connector portion 12 and through most of the tubular portion 18 of the receptacle 10. The bore 38 includes a reduced diameter portion 40 situated adjacent the distal end 20 of the receptacle 10 and inwardly from the hexagonal flange 24. The reduced diameter portion 40 is positioned and dimensioned for mating engagement with the terminal groove of an aircraft grounding plug, whereby the aircraft grounding plug is securely retained in engagement with receptacle 10. Another reduced diameter portion 41 of the bore 38 is located at the end 20 of the receptacle 10 within the flange 24.

As stated, the receptacle 10 is preferably formed from a single piece of electrically conductive material, for example, beryllium copper. The receptacle 10 may conveniently be formed utilizing a machine tool such as an automatic screw machine. The receptacle 10 may be formed on such a machine tool from a length of hexagonal bar stock having original external dimensions identical to those of the hexagonal portion 16 and the hexagonal flange 24 of the receptacle 10. By means of such a machine tool, the receptacle 10 may be manufactured by completely automatic techniques requiring no hand or manual operations whatsoever.

In certain applications of the invention, it may be desirable to cover the machined aircraft grounding receptacle 10 with a plating layer. For example, in one version of the invention the receptacle 10 is plated with cadmium. In another version of the invention the finished receptacle 10 is plated with silver. It will be understood that the receptacle 10 may be manufactured from materials other than beryllium copper, and that the receptacle 10 may be plated with materials other than cadmium and silver, in accordance with the requirements of particular applications of the invention.

Figure 1:
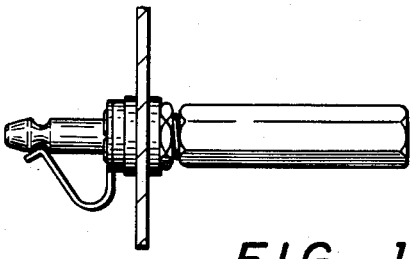
FIG. 1 (PRIOR ART)
FIG. 1 is an illustration of a prior art grounding receptacle and grounding plug.
Figure 2:
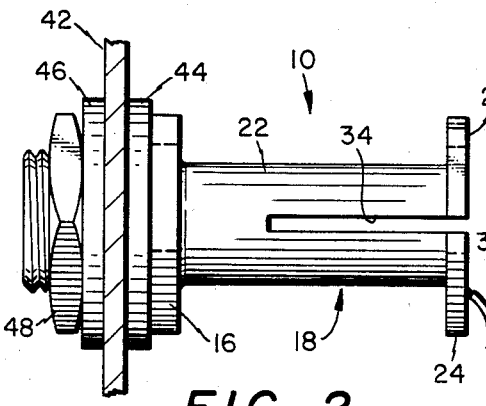
FIG. 2 is a side view of the aircraft grounding receptacle of the present invention.

The installation of the aircraft grounding receptacle 10 is illustrated in FIG. 2. The connector portion 12 of the receptacle 10 is inserted through a suitably dimensioned aperture formed in a panel 42 of an aircraft, or the like. A washer 44 is positioned on the connector portion 12 between the panel 42 and the hexagonal portion 16. Another washer 46 is positioned on the connector portion 12 on the opposite side of the panel 42. Either washer 44 or washer 46 may be a tooth lock washer. A nut 48 is threadedly engaged with the threads 14 of the connector portion 12 to secure the receptacle 10 in place. Wrenches or similar tools are engaged with the hexagonal portion 16 of the connector portion 12 of the receptacle 10 and with the nut 48 and are used to tighten the nut 48 sufficiently to secure the receptacle 10 to the panel 42. In the practice of the invention it has been found that because of its one-piece construction, the receptacle 10 is capable of withstanding approximately twenty times as much torque as is the case in the use of prior aircraft grounding receptacle designs.

If the panel 42 is formed from electrically conductive material and is sufficiently grounded, no additional electrical connection to the receptacle 10 is necessary. However, if the panel 42 is formed from an electrically nonconductive material or if the panel 42 is not sufficiently grounded, a grounding wire or lead 50 is used to form a grounding connection to the receptacle 10. The grounding wire 50 is connected to the receptacle 10 by inserting the wire through the hole 36 in the portion of the flange 24 comprising the segment 30 of the tubular portion 18 and then soldering the wire 50 in place. The grounding wire 50 is in turn extended to a grounded portion of the aircraft, for example, the engine. It will be understood that other techniques may be employed for forming a grounding connection to the receptacle 10, in accordance with the requirements or particular applications of the invention.

In the use of the aircraft grounding receptacle 10, an aircraft grounding plug 52 is inserted into the bore 38. The outside diameter of the plug 52 is substantially matched to the inside diameter of the main portion of the bore 38. As the end of the plug 52 engages the reduced diameter portion 40 of the bore 38 the segments 26, 28, 30 and 32 comprising the tubular portion 18 of the receptacle 10 are flexed outwardly. Then, as the terminal groove 54 of the plug 52 comes into alignment with the reduced diameter portion 40 of the receptacle 10, the segments flex inwardly to securely grip the plug in the receptacle 10 with the tip 56 of the plug 52 secured between the reduced diameter portions 40 and 41 of the bore 38.

Upon its insertion into the receptacle 10, the aircraft grounding plug is gripped between two sets of opposed contact segments. That is, the plug 52 is gripped between the segments 26 and 30 and is simultaneously gripped between the segments 28 and 32 comprising the tubular portion 18 of the receptacle 10. By this means the aircraft grounding plug 52 is substantially prevented from disengagement from the receptacle 10.

The amount of electrical resistance between the receptacle 10 and the plug 52 inserted therein depends at least to some extent on the contact pressure between the segments 26, 28, 30 and 32 and the plug 52. In the practice of the present invention this contact pressure is determined by the length of the slots 34. That is, the extent to which the slots extend into the tubular portion 18 of the receptacle 10 from the end 20, and also upon the thickness of the tubular portion 18 in the section 22. In the practice of the present invention it is possible to employ considerably greater contact pressure between the segments of the receptacle 10 and the plug 52 than is the case when prior grounding receptacle designs are used. This increased contact pressure substantially reduces the electrical resistance between the receptacle and the plug.

In actual practice it has been found that the aircraft grounding receptacle of the present invention forms a total of eight contact points with an aircraft grounding plug inserted therein. These eight contact points are situated on opposite sides of each of the four slots 34. This may be contrasted with the single contact point which is typical of most prior aircraft grounding receptacle designs. At least in part because of the eight contact point feature of the present invention, a continuous electrical connection between the receptacle 10 and the plug 52 is assured notwithstanding excessive vibration, mechanical shock, etc.

A feature of the present invention which is of particular importance comprises the hexagonal flange 24 and the manner in which the slots 34 intersect the flange 24. The flange 24 provides relatively heavy end portions for the segments 26, 28, 30 and 32 which serves to damp any movement of the segments in response to vibration. Perhaps more importantly, the portions of the flange 24 comprising the segments 26, 28, 30 and 32 serve to prevent harmonic response of the segments to engine vibrations or other vibrations which may occur within the aircraft, and thereby assures continuous electrical contact between the receptacle 10 and the aircraft grounding plug 52.

Another important feature of the present invention relates to its one-piece construction. Many prior aircraft grounding receptacle designs employ component parts which are formed from dissimilar metals. This can lead to increased electrical resistance. Also, the use of two or more component parts leads to mechanical weakness which is totally absent in the present invention. Further, the one-piece construction requires considerably less adjustment of the contact pressure and the positioning of inserted plugs than do the prior art receptacles.

Although particular embodiments of the invention have been illustrated in the accompanying Drawing and described in the foregoing Detailed Description, it will be understood that the present invention is not limited to the embodiments disclosed, but is capable of numerous rearrangements, modifications, and substitutions of parts and elements without departing from the spirit of the invention.

We claim:

1. An aircraft grounding receptacle comprising:

a unitary body of electrically conductive material;

said body of electrically conductive material having a first end comprising a connector portion;

said body of electrically conductive material having a second end comprising a tubular portion;

said tubular portion comprising a relatively small diameter portion extending from the connector portion and a relatively large diameter flange situated at said end of the body said flange extending perpendicularly to the tubular portion and comprising a substantial mass relative thereto;

said flange and said tubular portion being separated into segments by a plurality of slots extending into the body from said second end thereof toward the connector portion;

said body of electrically conductive material having a bore therethrough dimensioned to receive an aircraft grounding plug and including a reduced diameter portion situated adjacent said second end of the body which is adapted for mating engagement with the terminal groove of the aircraft grounding plug.

2. The aircraft grounding receptacle according to claim 1 wherein the connector portion of the body of electrically conductive material comprises an external thread situated at said one end of the body and a hexagonal portion situated adjacent the thread.

3. The aircraft grounding receptacle according to claim 1 wherein the tubular portion of the body of electrically conductive material is characterized by a total of four slots extending into the body from said second end thereof.

4. An aircraft grounding receptacle comprising:

a unitary body of electrically conductive material;

said body of electrically conductive material having a first end comprising a connector portion;

said body of electrically conductive material having a second end comprising a tubular portion;

said tubular portion comprising a relative small diameter portion extending from the connector portion and a relatively large diameter flange situated at said second end of the body;

said tubular portion being separated into segments by a total of four slots extending into the body from said second end thereof toward the connector portion;

said body of electrically conductive material having a bore therethrough dimensioned to receive an aircraft grounding plug and including a reduced diameter portion situated adjacent said second end of the body which is adapted for mating engagement with the terminal groove of the aircraft grounding plug;

said flange of the tubular portion of the body of conductive material being hexagonal in shape and wherein the four slots intersect the flange adjacent to but spaced apart from four of the six points comprising the hexagonal shape of the flange.

5. The aircraft grounding receptacle according to claim 4 further including a hole formed through the hexagonal flange for receiving a grounding lead.

6. An aircraft grounding receptacle comprising:

a unitary body of electrically conductive material, having first and second ends;

a connector portion including an external thread formed adjacent said first end of the body of electrically conductive material and a hexagonal portion situated at the end of the external thread remote from said first end of the body;

a tubular portion extending from the hexagonal portion of the connector portion to the second end of the body of electrically conductive material and including a relatively small diameter portion extending from the hexagonal portion toward the second end of the body and a hexagonal flange located at the second end of the body of electrically conductive material;

said tubular portion including four slots extending into the body from the second end thereof and separating the tubular portion of the body into four segments, said slots intersecting the hexagonal flange at locations adjacent to but spaced apart from four of the six points comprising the hexagonal shape of the flange;

a bore extending through the body of electrically conductive material and dimensioned to receive an aircraft grounding plug therein; and said bore including reduced diameter portions located adjacent the second end of the body adapted for mating engagement with the terminal groove of the aircraft grounding plug.

* * * * *